US011585518B1

(12) United States Patent
Simpson

(10) Patent No.: US 11,585,518 B1
(45) Date of Patent: Feb. 21, 2023

(54) TRAVERSABLE LIGHTING APPARATUS FOR ILLUMINATING A VIEWING SURFACE

(71) Applicant: Janita Laniece Simpson, Gary, IN (US)

(72) Inventor: Janita Laniece Simpson, Gary, IN (US)

( * ) Notice: Subject to any disclaimer, the term of this patent is extended or adjusted under 35 U.S.C. 154(b) by 0 days.

(21) Appl. No.: 17/581,932

(22) Filed: Jan. 23, 2022

(51) Int. Cl.

| | |
|---|---|
| ***F21V 21/088*** | (2006.01) |
| ***F21V 23/04*** | (2006.01) |
| ***F21L 4/04*** | (2006.01) |
| ***F21V 21/14*** | (2006.01) |
| ***F21V 33/00*** | (2006.01) |
| ***F21W 131/30*** | (2006.01) |

(52) U.S. Cl.
CPC ..... *F21V 21/088* (2013.01); *F21L 4/04* (2013.01); *F21L 4/045* (2013.01); *F21V 21/0885* (2013.01); *F21V 21/145* (2013.01); *F21V 23/04* (2013.01); *F21V 23/0414* (2013.01); *F21V 33/0048* (2013.01); *F21W 2131/30* (2013.01); *F21W 2131/3005* (2013.01)

(58) Field of Classification Search
CPC .... F21L 4/045; F21V 21/0885; F21V 21/145; F21V 33/0048; F21W 2131/3005
See application file for complete search history.

(56) References Cited

U.S. PATENT DOCUMENTS

| | | | | |
|---|---|---|---|---|
| 4,581,684 | A * | 4/1986 | Mazzucco | F21V 33/0048 362/183 |
| 6,022,119 | A * | 2/2000 | Booty, Jr. | F21V 27/00 362/450 |
| 10,980,304 | B2 * | 4/2021 | Volmer | F21L 4/04 |
| 2003/0179570 | A1 * | 9/2003 | Schnell | F21V 23/0414 362/116 |
| 2004/0246712 | A1 * | 12/2004 | Endo | F21V 21/29 362/396 |
| 2011/0267807 | A1 * | 11/2011 | Nelson | F16M 11/2021 362/427 |
| 2017/0314769 | A1 * | 11/2017 | Cacciabeve | F16B 2/10 |
| 2021/0033248 | A1 * | 2/2021 | Cacciabeve | F21V 21/30 |

FOREIGN PATENT DOCUMENTS

KR 20100011015 A * 2/2010

* cited by examiner

*Primary Examiner* — William N Harris

(57) ABSTRACT

An attachable lighting apparatus is presented for readily repositioning said lighting apparatus as attached to a viewing surface without detachment. The apparatus comprises a light housing section that adjusts to face a top surface of a viewing object, a side section attached to the light housing section that faces a side surface of the viewing object, a bottom section attached to the side section that faces a bottom surface of the viewing object, and a first roller device positioned about a mounting element, a portion of said first roller device protruding through an aperture within the light housing section, wherein a switch is triggered to activate one or more lighting elements of the light housing section when the light housing section faces the top surface of the viewing object.

20 Claims, 6 Drawing Sheets

100

300

400

TRAVERSABLE LIGHTING APPARATUS FOR ILLUMINATING A VIEWING SURFACE

BACKGROUND

It is difficult for readers to view printed elements (text, diagrams, pictures, etc., of varying color schemes) under limited lighting conditions. For example, a printed document affixed to a clipboard, notepad, tablet, or other item featuring a flat surface cannot be properly read and/or interpreted when lighting is poor. As another example, a reader cannot interpret the print within the pages of a book when the reading environment is dimly lit. In the absence of a suitable lighting source, users must employ a portable device such as a handheld flashlight or attachable lighting device (e.g., clip light) to illuminate the document.

Unfortunately, handheld flashlights limit the mobility and viewing flexibility of the reader given that one of the user's hands must hold the light in place. Similarly, in the case of an attachable lighting source, the reader must reposition the lighting device to accommodate different reading views and/or illuminate different portions of the viewing surface. For example, a lighting device attached to the lower portion of a clipboard must be manually detached, then reattached by the reader to actively illuminate the upper portion of the clipboard. There is currently no convenient means of enabling readers to reposition an attachable lighting device without detachment.

SOME EXAMPLE EMBODIMENTS

Therefore, there is a need for an approach for readily repositioning a lighting device attached to a viewing surface without detachment.

According to one embodiment, an attachable lighting apparatus comprises a light housing section that adjusts to face a top surface of a viewing object, said light housing section having a mounting element, one or more lighting elements for emitting a respective one or more beams of light in different directions when active, and a switch for electrically connecting a power supply to the one or more lighting elements. The attachable lighting apparatus further comprises a side section attached to the light housing section that faces a side surface of the viewing object. The attachable lighting apparatus further comprises a bottom section attached to the side section that faces a bottom surface of the viewing object. Still further, the attachable lighting apparatus comprises a first roller device positioned about the mounting element, a portion of said first roller device protruding through an aperture within the light housing section, said switch triggered to activate the one or more lighting elements when the light housing section faces the top surface of the viewing object.

Still other aspects, features, and advantages of the invention are readily apparent from the following detailed description, simply by illustrating several embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of an attachable lighting apparatus for traversing along a viewing surface is disclosed. In the following description, for the purpose of explanation, numerous specific details are set forth to provide a thorough understanding of the embodiments of the invention. It is apparent, however, to one skilled in the art that the embodiments of the invention may be practiced without these specific details or with an equivalent arrangement.

As noted previously, it is difficult for readers to view printed elements (text, diagrams, pictures, etc., of varying color schemes) under limited lighting conditions. For example, a reader cannot interpret the pages within a book when lighting conditions are poor. As another example, a printed document placed on a flat surface such as a clipboard, notepad, or tablet cannot be read when there is no illumination source. Consequently, readers must employ a portable device such as a handheld flashlight or attachable lighting device (e.g., clip light) to illuminate the document.

Unfortunately, handheld flashlights limit the mobility and viewing flexibility of readers given that one of the user's hands must hold the flashlight in place while they view the document. Even in the case where the flashlight or other light source is stationary (e.g., placed in a fixed position on a table), the amount of light emitted onto the viewing surface and lighting direction is limited by the position of the flashlight. Still further, in the case of an attachable lighting source, the reader must reposition the lighting device to accommodate different reading views and/or illuminate different portions of the viewing surface. For example, a clip light attached to the lower portion of a clipboard must be manually detached from its present position on the clipboard, then reattached to a new position on the clipboard to illuminate the upper portion. There is currently no convenient means of enabling readers to readily reposition a lighting device attached to a viewing surface without detachment.

Figure 1A:
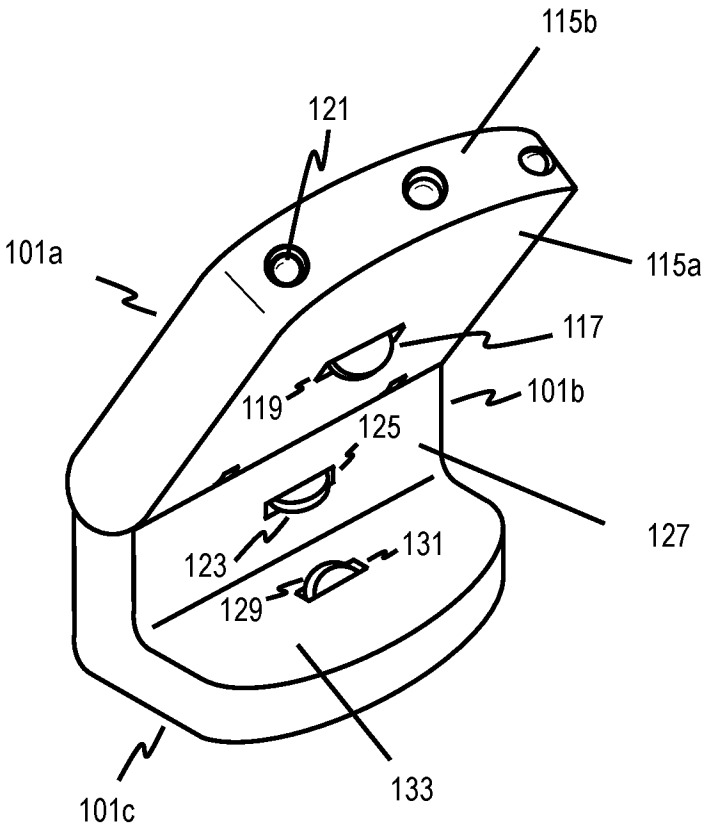
FIGS. 1A and 1B are diagrams of an attachable lighting apparatus for traversing along a viewing object, according to various embodiments.
Figure 1B:
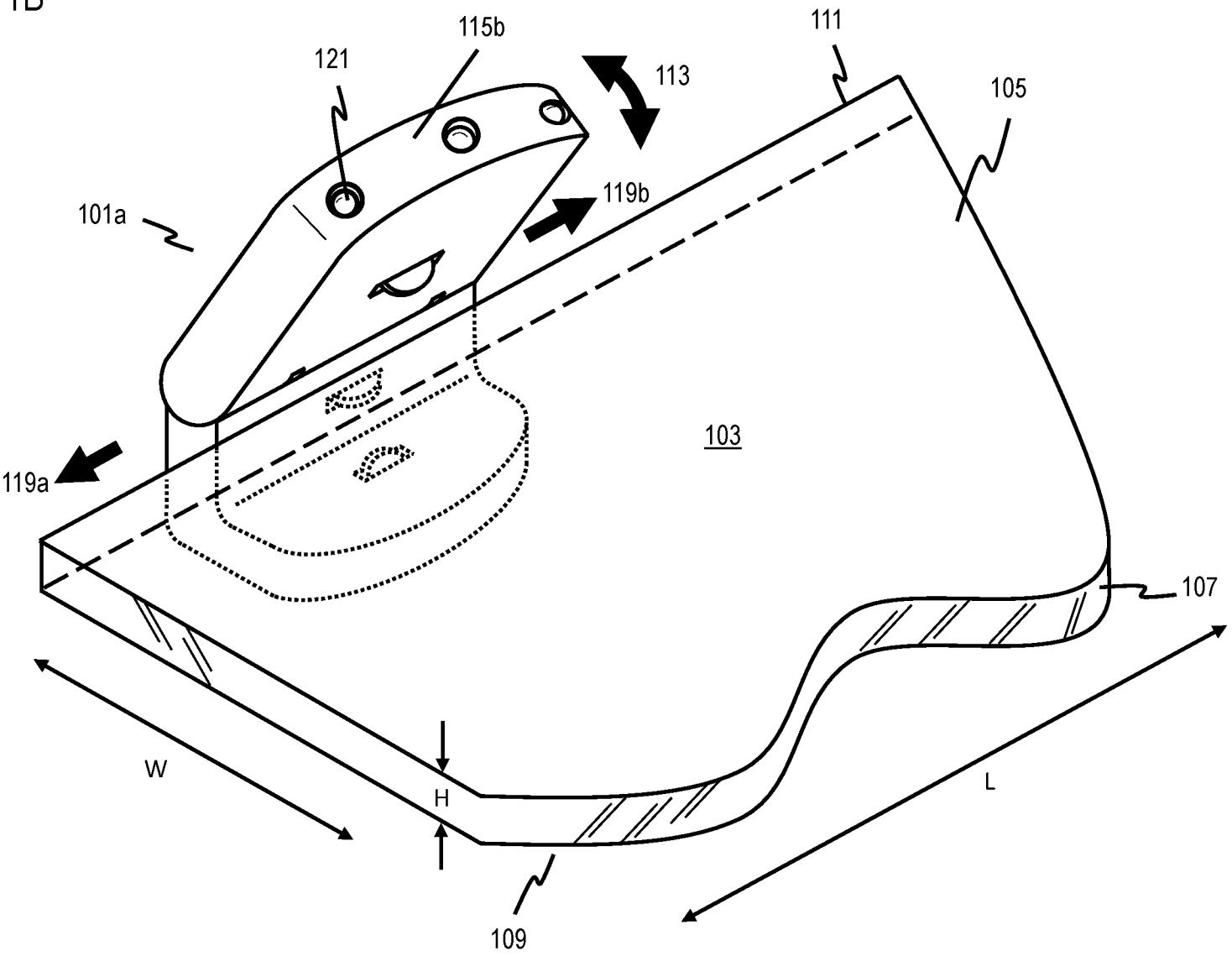

To address this issue, an attachable lighting apparatus that is capable of traversing along a viewing object readily once it is attached is presented in FIGS. 1A and 1B, according to various embodiments. By way of example, the lighting apparatus 100 may include one or more distinct sections 101*a*-101*c*, as shown in FIG. 1A. Each respective section 101*a*-101*c* is configured to conform to, approximate contact with, face, orient towards, and/or contour a respective surface of a viewing object to support attachment thereto and traversal thereof, the lighting apparatus 100. As such, each section 101*a*-101*c* of the lighting apparatus 100, while distinct, operate in tandem as a singular body to attach to and traverse along an edge, a side, a face, a contact plane, etc., of a viewing object. Still further, each section 101 may be composed of one or more materials of varying flexibility (e.g., plastic, aluminium) for housing various internal components while enabling adjustment of the lighting apparatus 100 with respect to the viewing object.

In FIG. 1B, a cross section of a viewing object 103 upon which the lighting apparatus 100 can be attached is presented. The viewing object 103 may be any item of varying height H, width W, and length L for providing one or more surfaces 105-109 upon which a document or other item may rest. Moreover, the viewing object 103 may be composed of a dense material suitable for placement, maintenance, or resting of said document or any other item upon it. For the purposes of illustration, exemplary viewing objects 103 to which the lighting apparatus 100 may attach include, but is not limited to, a clipboard, a tablet, a desktop, a table, a book cover or page, a notebook, a viewing screen (e.g., monitor), a keyboard, or the like.

The distinct surfaces of the viewing object 103 includes a top surface 105 upon which a document and/or item rests, a side surface 107, and a bottom surface 109. As such, each section 101*a*, 101*b*, and 101*c* of the attachable lighting apparatus 100 faces, orients towards, and/or contours a respective surface 105, 107, and 109 of viewing object 103. While depicted herein as a flat, rectangular object in FIG. 1B, the lighting apparatus 101 and exemplary embodiments thereof may also attach to viewing objects 103 of other configurations. For example, instead of a straight edge 111 as depicted, the viewing object 103 may have curved edges, jagged edges, uneven corners, sections of varying height, etc.

In one embodiment, the light housing section 101*a* adjusts to face the top surface 105 of the viewing object 103. By way of example, the light housing section 101*a* may adjust rotationally as depicted by the multi-directional arrow 113 in FIG. 1B. A downward rotation corresponds to movement of the light housing section 101*a* towards the top surface 105 of the viewing object 103—i.e., such that a face 115*a* (per FIG. 1A) of the light housing section 101*a* approximates or substantially faces the top surface 105. Conversely, an upward rotation corresponds to movement of the light housing section 101*a* away from the top surface 105. While not shown expressly herein, rotation of the light housing section 101*a* may occur about at least one pivot, said at least one pivot generating a rotation axis for the light housing section 101*a*. It is noted, therefore, that a reader can readily adapt the extent to which the light housing section 101 approximates contact with the top surface 105.

Alternatively, the light housing section 101*a* may adjust vertically. As such, a downward vertical adjustment corresponds to movement of the light housing section 101*a* towards the top surface 105 of the viewing object 103—i.e., such that a face 115*a* (per FIG. 1A) of the light housing section 101*a* approximates or substantially faces the top surface 105. Conversely, upward vertical adjustment corresponds to movement of the light housing section 101*a* away from the top surface 105. While not shown expressly herein, the vertical adjustment may occur about at least one slide shaft, said at least one slide shaft generating a horizontal axis that connects the light housing section 101*a* to the side section 101*b*. Per this scenario, the light housing section 101*a* may include an aperture for enabling passage of the side section 101*b* as the light housing section 101*a* is lowered along the at least one slide shaft.

More details regarding the rotational and vertical adjustment of the light housing section 101*a* relative to the side section 101*b* is presented later herein, particularly with respect to FIGS. 2A and 2B. It is noted, however, that the attachable lighting apparatus 100 may contemplate various implementation, configuration, and/or design approaches for supporting attachment of the lighting apparatus 100 to a viewing object 103.

In one embodiment, the light housing section 101*a* maintains a first roller device 117. The first roller device 117 is mounted about a mounting element (not shown) for positioning the first roller device 117 within the light housing section 101*a*. Under this scenario, at least a portion of the first roller device 117 extends and/or protrudes through an aperture 119 within the light housing section 101*a*. The aperture 119 is positioned on the face 115*a* of the light housing section 101*a*. As such, the first roller device 117 contacts the top surface 105 of the viewing object 103 (per FIG. 1B) when the light housing section 101*a* approximates, or substantially faces, the top surface 105 of the viewing object 103. As noted previously, this occurs when the light housing section 101*a* of the attachable lighting apparatus 100 is adjusted downward vertically and/or horizontally.

By way of example, the first roller device 117 may be a wheel or spherical object such as a ball that makes direct contact with the top surface 105 when the light housing section 101*a* is positioned downward. The extent of surface area covered by the wheel or ball upon contact with the top surface 105 will vary depending on the material of which the wheel or ball is composed, the length and width of the wheel footprint, etc. Regardless of implementation, the first roller device 117 enables the light housing section 101*a* to traverse the top surface 105 when the portion of said first roller device 117 makes contact. As such, a reader may adapt the position and/or location of attachment of the light housing section 101*a* along the straight edge 111 side of the viewing object 103 in conjunction with, or relative to, the side section 101*b* and bottom section 101*c*. In this example, traversal of the lighting apparatus 100 along the top surface 105 is depicted by directional arrows 119*a* and 119*b*.

In one embodiment, the light housing 101*a* maintains one or more lighting elements 121 for emitting a respective one or more beams of light in different directions. By way of example, the one or more lighting elements may be light emitting diodes (LEDs), bulbs, or any other lighting means for emitting light when active. As depicted herein, the light housing section 101*a* includes three LED lights, each of which are positioned to face an opening within a forward facing surface 115*b* of the light housing section 101*a*. In this case, the lighting elements 121 are separated from one another across the forward facing surface 115*b*, with each respective lighting element 121 varying in direction to maximize light dispersion.

In an alternate embodiment (not shown), the one or more lighting elements 121 may be more tightly packed, wherein limited to no spacing exists between them to enable a more concentrated beam of light. Still further, in another alternate embodiment (not shown), a singular lighting element 121 of suitable dimensions for extending across the forward facing surface 115*b* may be employed. Under this scenario, the singular lighting element 121 may be curved—i.e., to match the curvature of the exemplary forward facing surface 115*b*—for impacting the angular dispersion of light about the top surface 105 of the viewing object 103.

In another alternate embodiment (not shown), the forward facing surface 115*b* of the light housing section 101*a* may be formed as a light cover. As such, the forward facing surface 115*b* may be composed of a material suitable for scattering light accordingly. Alternatively, the forward facing surface

115*b* may be configured to modify or focus the beams of light emitted by the one or more lighting elements 121 as opposed to exposing them directly via one or more openings. The exemplary embodiments described herein contemplate any implementation of lighting elements 121 as arranged and/or oriented within the light housing section 101*a*. It is noted that the light housing section 101*a* functions as the section of the lighting apparatus 100 for housing various components that support the emission of light upon attachment to the viewing object 103.

In one embodiment, the side section 101*b* of the lighting apparatus 100 is configured to face a side surface 107 of the viewing object 105. As depicted in FIGS. 1A and 1B, the side section 101*b* includes a second roller device 123 that makes direct contact with the side surface 107 when the lighting apparatus 100 is attached to the viewing object 103. Per this scenario, at least a portion of the second roller device 123 extends and/or protrudes through an aperture 125 within the side section 101*b*. The aperture 125 is positioned on a face 127 of the side section 101*b*. As such, the second roller device 123 contacts the side surface 107 of the viewing object 103 when the side section 101*b* approximates, or substantially faces, the side surface 107.

The second roller device 123 enables the side section 101*b* to traverse the side surface 107 when the portion of said second roller device 123 makes contact. As such, a reader may adapt the position of attachment of the side section 101*b* along the straight edge 111 side of the viewing object 103 in conjunction with, or relative to, the light housing section 101*a* and bottom section 101*c*. In this example, traversal of the lighting apparatus 100 along the side surface 107 is depicted by directional arrows 119*a* and 119*b*, of FIG. 1B. Like the first roller device 117, the second roller device 123 may be a wheel, ball, or the like that makes direct contact with the side surface 107 when the lighting apparatus 100 is attached. It is noted that the side section 101*b* may be attached to the light housing section by way of a pivot.

In another embodiment, the bottom section 101*c* of the lighting apparatus 100 is configured to face a bottom surface 109 of the viewing object 105. As depicted in FIGS. 1A and 1B, the bottom section 101*c* includes a third roller device 129 that makes direct contact with the bottom surface 109 when the lighting apparatus 100 is attached to the viewing object 103. Per this scenario, at least a portion of the third roller device 129 extends and/or protrudes through an aperture 131 within the bottom section 101*c*. The aperture 131 is positioned on a face 133 of the side section 10 lb. As such, the third roller device 129 contacts the bottom surface 109 of the viewing object 103 when the side section 101*b* approximates, or substantially faces, the side surface 107 of the viewing object 103.

The third roller device 129 enables the third section 101*c* to traverse the bottom surface 109 when the portion of said third roller device 129 makes contact. As such, a reader may adapt the position of attachment of the bottom section 101*c* along the straight edge 111 side of the viewing object 103 in conjunction with, or relative to, the light housing section 101*a* and side section 10 lb. In this example, traversal of the lighting apparatus 100 along the bottom surface 109 is depicted by directional arrows 119*a* and 119*b*, of FIG. 1B. Like the first roller device 117 and second roller device 123, the third roller device 129 may be a wheel, a ball, or the like that makes direct contact with the bottom surface 109 when the lighting apparatus 100 is attached.

As noted previously, the light housing section 101*a*, side section 101*b*, and bottom section 101*c* operate in tandem as a singular body to attach to and traverse along a viewing object 103. Operationally, each section 101*a*-101*c* contours the side edge 111 a respective face 105-109 of the viewing object 103 while enabling seamless repositioning of the lighting apparatus 100 when required by the reader. Each section 101*a*-101*c* may be composed of one or more materials of varying flexibility (e.g., plastic, aluminium, wiring) for housing the various internal components of the lighting apparatus 100 while also enabling flexibility of a respective section 101*a*-101*c*. For example, the side section 101*b* and bottom section 101*c* may be bendable at the discretion of the reader for enabling the lighting apparatus 100 to attach to and/or contour the straight edge 111.

Hence, the lighting apparatus 100 may accommodate viewing objects 103 of varying size and configurations. Still further, in another embodiment, one or more of the roller devices may also be composed of a pliable material for enabling them to conform to, or better contour, a respective surface. For example, the second and third roller devices 123 and 129 respectively may be made from rubber, plush, or the like for conforming to the respective surfaces 107 and 109 of the viewing object 103.

Figure 2A:
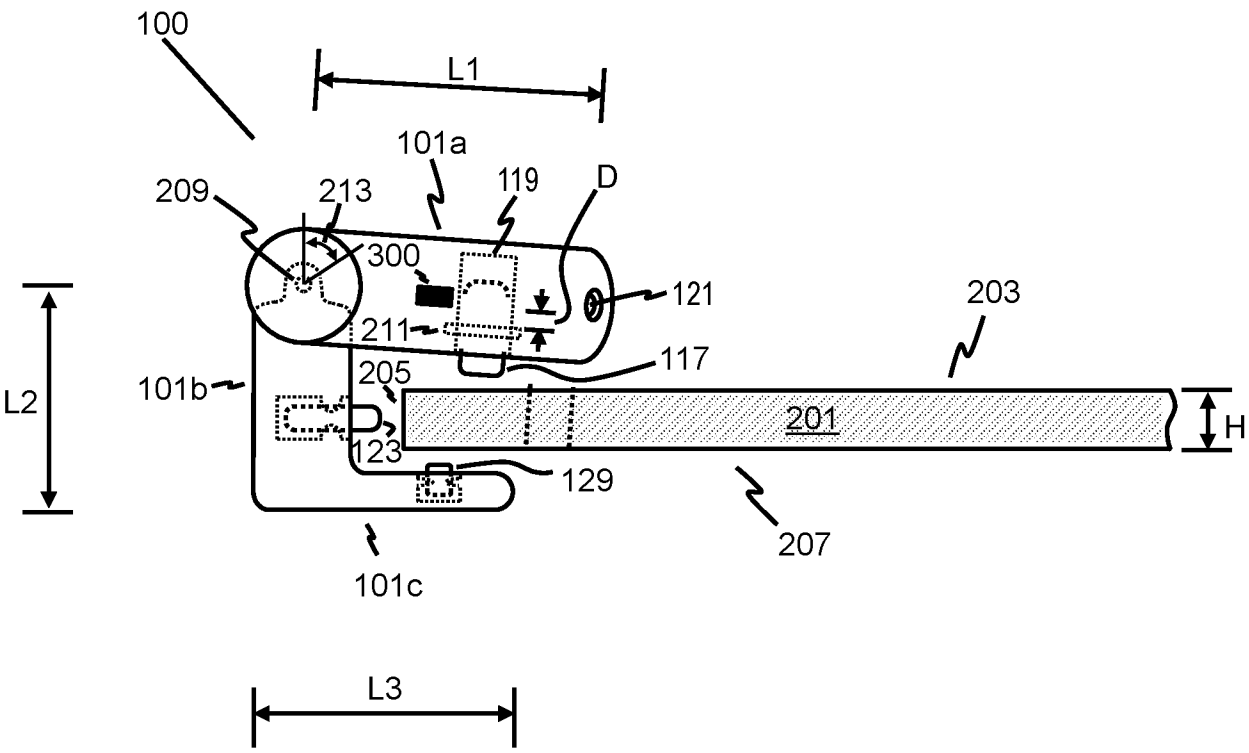
FIG. 2A is a diagram of the attachable lighting apparatus of FIGS. 1A and 1B from a side perspective, according to one embodiment.

FIG. 2A is a diagram of the attachable lighting apparatus of FIGS. 1A and 1B from a side perspective, according to one embodiment. The diagram depicts the various internal components of the lighting apparatus 100 of FIGS. 1A and 1B that enable its operation. In addition, the diagram depicts the placement and/or attachment of the lighting apparatus 100 to a viewing object 201. Under this scenario, the light housing section 101*a* of the lighting apparatus is rotated downward to face the top surface 203 of the viewing object 201 while the side section 101*b* and bottom section 101*c* face the side and bottom surfaces 205 and 207 respectively. Resultantly, roller wheels 117, 123, and 129 contact the respective surfaces 203, 205, and 207 accordingly to facilitate traversal of the lighting apparatus 100.

By way of example, the light housing section 101*a* is shown as being connected to the side section 101*b* by way of at least one pivot 209. The pivot 209 may be implemented as a rod or shaft (not shown) that extends through the light housing section 101*a* and the side section 101*b*. Alternatively, the pivot 209 may be implemented as complementary mounts (not shown) on respective sides of the light housing section 101*a* and/or side section 101*b*. Regardless of implementation, the exemplary embodiments herein contemplate any arrangement of pivot suitable for generating a rotation axis about which the light housing section 101*a* may rotate and/or connect.

As depicted in the diagram, the light housing section 101*a* is rotated downward to face the top surface 203 of the viewing object 201 to approximate, or substantially face, the top surface 203. The extent to which the light housing section 101*a* spans across the top surface 203 to face the top surface 203 depends on a length L1 of the light housing section 101*a*. The length L1 may also influence the extent to which light is dispersed onto the top surface 203 as emitted via the lighting elements 121. Similarly, the extent to which the lighting apparatus can accommodate viewing objects 201 of varying height H depends on the length L2 of the side section 101*b*. Under this scenario, the length L2 must exceed the height H of the side surface 205 to enable the lighting apparatus to attach to the side edge of the viewing object 201. Still further, the extent to which the bottom section 101*c* spans across the bottom surface 207 depends on a length L3 of the bottom section 101*c*. The length L3 may also influence the extent to which the lighting apparatus grips the viewing object 201.

It is noted that different configurations of the attachable lighting apparatus may be employed for supporting attachment of the lighting apparatus, including configurations wherein: (1) the length L2 of the side section 101*b* exceeds the height H of the viewing object 201; (2) the length L1 of the light housing section 101*a* and the length L3 of the bottom section 101*c* are equivalent; and/or (3) the length L1 of the light housing section 101*a* and the length L3 of the bottom section 101*c* are not equivalent. Still further, the extent of attachment may vary depending on the composition of the light housing section 101*a*, the side section 101*b*, and the bottom section 101*c*. For example, at least a portion of the light housing section 101*a*, at least a portion of the side section 101*b*, at least a portion of the bottom section 101*c*, or a combination thereof, may be composed of flexible material—i.e., bendable wiring, malleable metal, form fitting plastic.

As depicted in FIG. 2A, the light housing section 101*a* houses various internal components for enabling light to be cast onto the top surface 203 of the viewing object 201. This includes, for example, the one or more lighting elements 121, each of which are configured to emit a respective one or more beams of light in different directions when active. In one embodiment, a mounting element 211 is also maintained within the light housing section 101*a* for mounting the first roller device 117. The mounting element 211 positions the first roller device 117 such that it protrudes through an aperture 119. By way of example, the mounting element 211 may be a rod, a shaft, a stem, or the like. Under this scenario, the aperture 119 is wide and deep enough to encompass the roller device 117 and permit its upward or downward movement within the light housing section 101*a* by a distance D.

In one embodiment, the lighting elements 121 are activated by way of a switch for electrically connecting a power supply to the one or more lighting elements 121. As will be described later with respect to FIG. 3, the switch, power supply, and other components may be elements within an arrangement of circuitry 300 housed within the attachable lighting apparatus to which the lighting elements connect. The switch is triggered when the mounting element 211 is offset from an inactive position to an active position by a predetermined distance D.

In this case, the offset occurs when the portion of said first roller device 117 contacts the top surface 203 of the viewing object based on the extent of the adjustment (vertically or rotationally). The direction of offset (upward) opposes the top surface 203 of the viewing object 201—such that greater downward pressure applied by the reader to the light housing section 101*a* triggers activation of the lighting elements 121. It is noted, therefore, that the lighting apparatus 100 supports automatic activation of the one or more lighting elements 121. Even under low lighting conditions, readers may attach the lighting apparatus 100 to the viewing object 201 and activate (or deactivate) the lighting apparatus 100 at their discretion via touch.

In an alternate embodiment, that the lighting apparatus 100 may also be activated when a predetermined angle of rotation of the light housing section 101*a* is met. Under this scenario, the predetermined angle of rotation 213 may correspond to an extent of offset from a 90 degree position of the light housing section 101*a* about the at least one pivot 209. Moreover, the circuitry 300 may be positioned within the lighting apparatus in a manner that enables triggering of the switch due to rotational adjustment by the reader. Consequently, per this approach, the lighting elements 121 are activated by means other than movement of the mounting element 211 by the offset distance D.

Figure 2B:
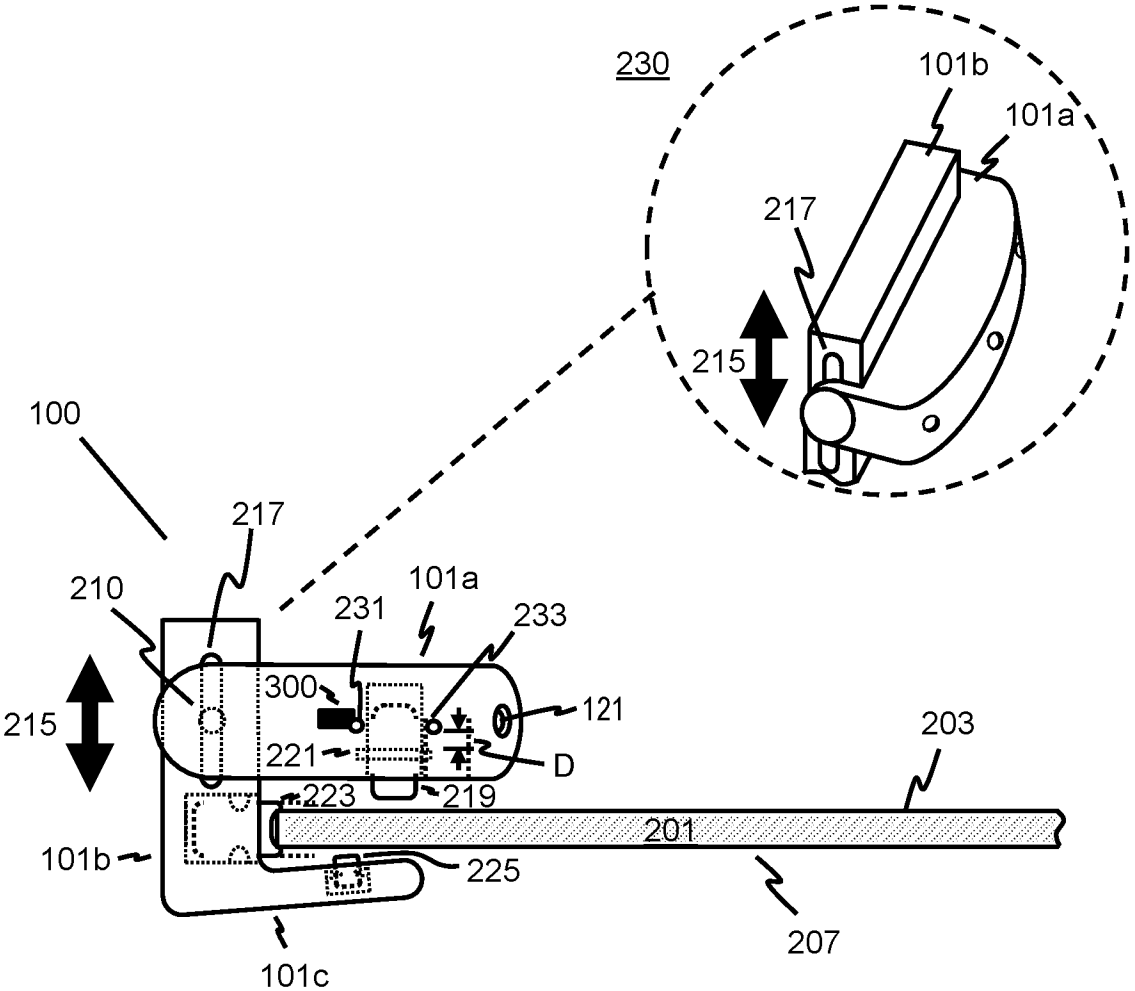
FIG. 2B is a diagram of an alternate embodiment of the attachable lighting apparatus for traversing along a viewing object, according to one embodiment.

FIG. 2B is a diagram of an alternate embodiment of the attachable lighting apparatus for traversing along a viewing object, according to one embodiment. Per this configuration, the light housing section 101*a* is shown to adjust vertically rather than rotationally as described in FIG. 2A. Vertical adjustment of the light housing section 101*a*—as depicted by multidirectional arrow 215—is enabled by shifting the pivot 210 along a slide shaft 217. Hence, the slide shaft 217 generates a vertical axis that connects the light housing section 101*a* to the side section 101*b* accordingly. The vertical adjustment 215 is enabled by way of an aperture through which the side section 101*b* extends through the light housing section 101*a*. Alternatively, the light housing section 101*a* may include an opening for wrapping around, extending around, and/or connecting to the side section 101*b* to permit vertical movement along the slide shaft 217. The latter configuration is depicted in the magnified, three-dimensional, top-down view 230.

As shown per the top-down view 230, the light housing section 101*a* includes hinges or extended sides for connecting the light housing section 101*a* to respective sides of the side section 101*b*. The connection occurs via respective slide shafts 217 that run along the side of the side section 101*b*. Resultantly, the light housing section 101*a* can be shifted downward to approximate or substantially face the top surface 203 of the viewing object 201. When enough pressure/downward movement of the light housing section 101*a* is applied, the first roller device 219 causes the mounting element 221 to be offset by a distance D—resulting in activation of the lighting elements 121.

In one embodiment, the mounting element 221 may itself be configured as a switch for electrically connecting the lighting elements 121 to the circuit 300. Per this scenario, movement of the mounting element 221 to an active position due to the offset distance D being met causes respective ends of the mounting element 221 to contact a switch node 231 and a connecting node 233 of the lighting elements 121. As such, the mounting element 221 serves as a means of mounting the first roller device 219 while also enabling completion of the circuit for activating the one or more lighting elements 121. It is noted, in this example, that the mounting element 221 may be composed of a material for supporting the flow of electrical current from the circuit 300 to the lighting elements 121. In addition, the first roller device 219 may also be composed of a non-conductive material for preventing the flow of electrical current through said roller device 219.

In one embodiment, the one or more of the roller devices 219, 223, and 225 may also be composed of a pliable material for enabling them to conform to, or better contour, a respective surface. By way of example, the second and third roller devices 223 and 225 may be made of rubber, plush, or the like for conforming to respective surfaces of the viewing object 103. For example, when the second roller device 223 contacts a side face of a thin viewing object 201, the wheel pushes into the side face such that it concaves, folds over, or overlaps the side portions of the viewing object 201.

Figure 3:
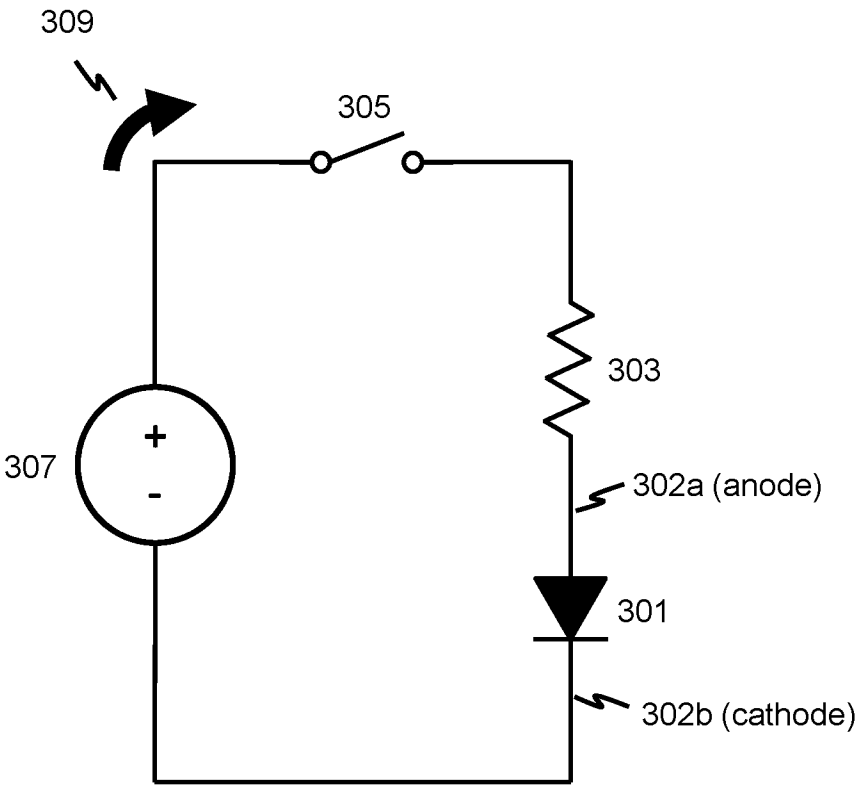
FIG. 3 is a diagram of a switch activated electrical circuit housed within the attachable lighting apparatus of FIGS. 1A-2B, according to various embodiments.

FIG. 3 is a diagram of a switch activated electrical circuit housed within the attachable lighting apparatus of FIGS. 1A-2B, according to one embodiment. As noted previously, the circuit 300 may include various elements for electrically activating the lighting elements. In this example, the lighting element is shown as a light emitting diode (LED) 301. While shown as a single LED 301, it is noted that multiple LEDs may be connected accordingly. As such, the LEDs may be electrically connected in different ways (e.g., in series, in parallel).

Still further, the anode 302*a* of the LED 301 is connected to a resistor 303 for buffering electrical current while the cathode 302*b* is connected to a negative end of a power supply 307. Moreover, a positive end of the power supply 307 is attached to a switch 305 for triggering activation, or connecting of, the power supply 307 to the LED 301. As such, when the switch 305 is triggered, the power supply 307 causes current 309 to flow throughout the circuit accordingly.

It is noted in the exemplary embodiments herein, that while the circuity 300 as shown in FIGS. 2A-2B are positioned with the light housing section 101*a,* it can be positioned within other sections of the attachable lighting apparatus. For example, the circuitry 300 may be positioned within the bottom section 101*c*. In addition, the circuitry 300 may be distributed about the lighting apparatus 100 but interconnected accordingly. For example, the power source 307 may be in the bottom section 101*c* near a battery port—i.e., for permitting replacement of batteries by the reader. In addition, the switch 305 may be electrically connected to the power source 307 but located in the side section 101*b* for activating the lighting elements 301 positioned within the light housing section when a predetermined angle of rotation 213 is met. Any arrangement of the respective elements of circuitry 300, circuitry design configuration, or a combination thereof for enabling activation of the lighting elements 121 may be employed.

Figure 4:
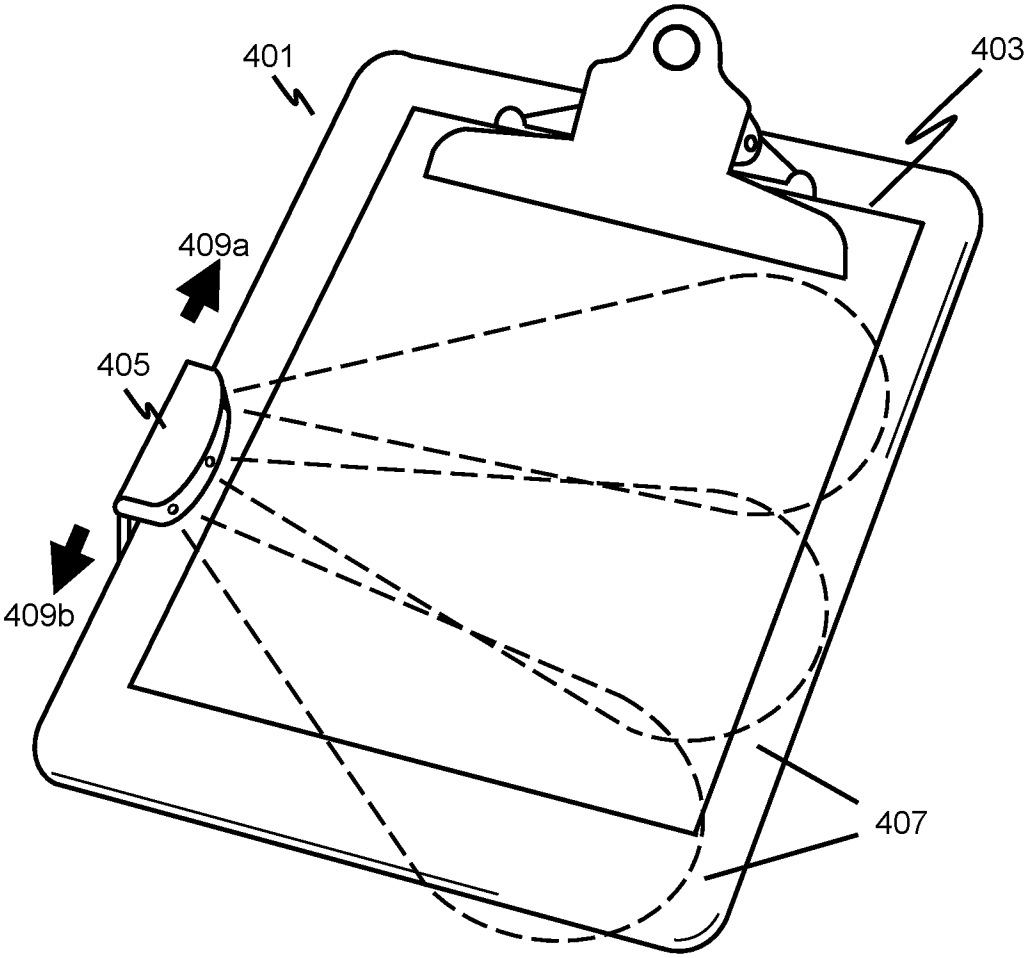
FIG. 4 is a diagram of the attachable lighting apparatus of FIGS. 1A and 1B in operation for emitting light onto a viewing surface in multiple directions, according to one embodiment.

FIG. 4 is a diagram of the attachable lighting apparatus of FIGS. 1A and 1B in operation for emitting light onto a viewing surface in multiple directions, according to one embodiment. The viewing object is a clipboard 401 that affixes a sheet of paper 403 to a reading surface. Under this scenario, a reader can attach the lighting apparatus 405 to the side edge of the clipboard 401 and activate the lighting elements by adjusting the light housing section downward. As such, one or more beams of light 407 are directed onto the reading surface to illuminate the sheet of paper 403. It is noted that the extent of light diffusion of said beams 407 may vary depending on the lighting configuration, intensity, etc. It is further contemplated, in certain embodiments, that the lighting apparatus may be configured to enable variable intensity of lighting 407 based on variation of the pressure applied by the reader to the light housing section.

Still further, the reader may adapt the position of the lighting apparatus 405 as attached to the side edge of the clipboard 401. In this case, the reader may shift the lighting apparatus 405 upward 409*a* to enable the light beams 407 to be directed towards the top portion of the sheet of paper. Conversely, the reader may shift the lighting apparatus 405 downward 409*b* to direct more light to the top portion. Hence, the reader can adapt the position of the lighting apparatus 405 without having to detach it once activated.

The exemplary embodiments herein enable several advantages to readers. In one advantage, the attachable lighting apparatus enables readers to affix a light to a viewing object where poor lighting conditions are imminent. Still further, the attachable lighting apparatus enables lighting elements to be automatically activated or deactivated based on the vertical or rotational adjustment of the apparatus. Hence, the reader may activate or deactivate the light readily as needed by simply adjusting the amount of pressure applied to the lighting apparatus 405 and/or the position of the lighting apparatus 405. As another advantage, the lighting apparatus may be configured to enable variable intensity of lighting based on variation of the pressure applied by the reader to the light housing section.

While the invention has been described in connection with several embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. An attachable lighting apparatus, comprising:

a light housing section that adjusts to face a top surface of a viewing object, said light housing section having a mounting element, one or more lighting elements for emitting a respective one or more beams of light in different directions when active, and a switch for electrically connecting a power supply to the one or more lighting elements;

a side section attached to the light housing section that faces a side surface of the viewing object;

a bottom section attached to the side section that faces a bottom surface of the viewing object; and a first roller device positioned about the mounting element, a portion of said first roller device protruding through an aperture within the light housing section, said switch triggered to activate the one or more lighting elements when the light housing section faces the top surface of the viewing object.

2. The attachable lighting apparatus of claim 1, wherein the first roller device is a wheel or a ball.

3. The attachable lighting apparatus of claim 1, wherein the light housing section is traversable along the top surface when the portion of said first roller device contacts the top surface.

4. The attachable lighting apparatus of claim 1, wherein the adjustment of the light housing section is vertical, rotational, or a combination thereof.

5. The attachable lighting apparatus of claim 4, wherein the rotational adjustment occurs about at least one pivot, said pivot connecting the light housing section to the side section, and wherein the vertical adjustment occurs about at least one slide shaft, said slide shaft connecting the light housing section to the side section.

6. The attachable lighting apparatus of claim 5, wherein the switch is triggered when a predetermined angle of rotation is met.

7. The attachable lighting apparatus of claim 1, wherein the portion of said first roller device contacts the top surface of the viewing object based on an extent of the adjustment of the light housing section.

8. The attachable lighting apparatus of claim 7, wherein the switch is triggered when the mounting element is offset from a rest position by a predetermined distance when the first roller device contacts the top surface.

9. The attachable lighting apparatus of claim 8, wherein a direction of the offset, an extent of the offset, or a combination thereof opposes the top surface of the viewing object.

10. The attachable lighting apparatus of claim 1, further comprising:

a second roller device mounted within the side section of the light housing section, a portion of said second roller device protruding through an aperture within the side section for contacting the side surface of the viewing object.

11. The attachable lighting apparatus of claim 10, wherein the side section is traversable along the side surface when the portion of said second roller device contacts the side surface of the viewing object and the second roller device is a wheel or a ball.

12. The attachable lighting apparatus of claim 10, wherein the second roller device is pliable for contouring the side surface of the viewing object when contact is made.

13. The attachable lighting apparatus of claim 1, further comprising:

a third roller device mounted within the bottom section, a portion of said third roller device protruding through an aperture within the bottom section for contacting the bottom surface of the viewing object.

14. The attachable lighting apparatus of claim 13, wherein the bottom section is traversable along the bottom surface when the portion of said third roller device contacts the bottom surface.

15. The attachable lighting apparatus of claim 13, wherein the third roller device is a wheel or a ball.

16. The attachable lighting apparatus of claim 1, wherein the one or more beams of light are emitted onto at least a portion of the top surface of the viewing object.

17. The attachable lighting apparatus of claim 1, wherein a length of the side section exceeds a height of the viewing object.

18. The attachable lighting apparatus of claim 1, wherein a length of the light housing section and a length of the bottom section are equivalent.

19. The attachable lighting apparatus of claim 1, wherein a length of the light housing section and a length of the bottom section are not equivalent.

20. The attachable lighting apparatus of claim 1, wherein at least a portion of the light housing section, at least a portion of the side section, at least a portion of the bottom section, or a combination thereof, is flexible.

* * * * *